US007378610B2

(12) United States Patent
Umezawa et al.

(10) Patent No.: US 7,378,610 B2
(45) Date of Patent: May 27, 2008

(54) MAIL SORTING AND DISTRIBUTING TRANSFER SYSTEM

(75) Inventors: Kenji Umezawa, Osaka (JP); Shogo Okamoto, Osaka (JP); Masahiro Asukai, Osaka (JP); Masahiko Yoshida, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 605 days.

(21) Appl. No.: 10/962,152

(22) Filed: Oct. 7, 2004

(65) Prior Publication Data

US 2005/0116405 A1 Jun. 2, 2005

(30) Foreign Application Priority Data

Nov. 27, 2003 (JP) ..... 2003-398020

(51) Int. Cl.
*B07C 5/00* (2006.01)

(52) U.S. Cl. ..... 209/584; 209/900; 209/559; 198/346.2

(58) Field of Classification Search ..... 209/584, 209/900, 559; 198/370.03, 346.2; 44/285, 44/749.6

See application file for complete search history.

(56) References Cited

U.S. PATENT DOCUMENTS 2,580,229 A 12/1951 Kendall
3,148,783 A 9/1964 Michaels
3,782,541 A 1/1974 Wood
4,804,078 A 2/1989 Scata'
4,874,281 A * 10/1989 Bergerioux et al. ..... 414/285
5,419,457 A 5/1995 Ross et al.
5,570,773 A * 11/1996 Bonnet ..... 198/370.04
5,718,321 A 2/1998 Brugger et al.
6,135,101 A * 10/2000 Konno et al. ..... 123/688
6,136,101 A * 10/2000 Sugawara et al. ..... 148/321
6,276,509 B1 8/2001 Schuster et al.
6,501,041 B1 12/2002 Burns et al.
6,561,339 B1 * 5/2003 Olson et al. ..... 198/349
6,747,231 B1 * 6/2004 Bretschneider et al. ..... 209/584
6,979,793 B2 * 12/2005 Shiibashi et al. ..... 209/584

(Continued)

FOREIGN PATENT DOCUMENTS

CH 636285 5/1983

(Continued)

*Primary Examiner*—Patrick H. Mackey
*Assistant Examiner*—Terrell H Matthews
(74) *Attorney, Agent, or Firm*—Dann, Dorfman, Herrell and Skillman, P.C.; Henry H. Skillman

(57) ABSTRACT

A mail sorting and distributing transfer system, which smoothly conveys mail on a mail sorting line having a compound curve whose line is not in a plane, but is three-dimensional, whereby the mail can be reliably transferred to a conveyor basket and conveying power savings are achieved. The system 100 receives mail in a transfer basket 120 hung at an outer circumferential edge of a mail sorting and distributing turn table 110 and transfers the mail through a transfer port 122 to a conveyor basket 130, which circulates on a mail sorting line O. The conveyor basket 130 includes an inner circumferential side carriage 131 and an outer circumferential side carriage 132, which respectively travel on an inner circumferential side rail 142 and an outer circumferential side rail 143 of the mail sorting line O while hanging a basket body 133 by both sides in a carried state.

1 Claim, 6 Drawing Sheets

U.S. PATENT DOCUMENTS

2003/0209473 A1 11/2003 Brinkley et al.

FOREIGN PATENT DOCUMENTS

DE 4202244 A1 7/1993
EP 0 398 673 A3 11/1990
EP 0 949 015 A2 10/1999
JP 2-5473 2/1990

* cited by examiner

MAIL SORTING AND DISTRIBUTING TRANSFER SYSTEM

RELATED APPLICATION

This application claims the priority of Japanese Application No. 2003-398020, filed Nov. 27, 2003.

FIELD OF INVENTION

The present invention relates to a mail sorting and distributing conveyor system, which receives mail supplied from a mail charging line provided with a mail sorting receiver's data reader or the like, and transfers the mail to conveyor baskets on the mail sorting line for sorting the mail in accordance with the mail sorting receiver's data.

BACKGROUND OF THE INVENTION

A conventional mail sorter includes a synchronous transfer section, which charges mail into a conveyor box while mail holder sections are shifted in synchronization with the movement of the conveyor boxes for sorting the mail, so that the mail holder sections are adapted to transfer the mail to the conveyor boxes while a fixed section is moving in synchronization with the movement of the conveyor boxes.

Such a conventional mail sorter must transfer mail timely to a moving conveyor box through a mail holder section. However, the time interval when a receipt port of the conveyor box registers with the mail holder is an instant, and, after that, the facing state of both the receipt port of the conveyor box and the mail holder section is gradually changed to a V-shaped, bent arrangement state and the conveyor box and mail holder are separated from each other. Thus, transferable time therebetween is short, and when the transfer timing is shifted even a little, transfer failure can be often generated.

Thus, to be able to reliably transfer mail supplied from the mail charging line timely to a conveyor basket on the mail sorting line by extending the transferable time for mail the present inventors developed a mail sorting and distributing transfer system 200 in which after mail supplied from the mail charging line as shown in FIG. 6 was received in a transfer basket 220 hung at an outer circumferential edge of a mail sorting and distributing turn table 210, the mail is transferred to a predetermined conveyor basket 230, which circulates on a mail sorting line through an openable transfer port 222 provided on the bottom of the transfer basket 220.

However, since the mail sorting and distributing transfer system 200, which is a related art of the present invention as shown in FIG. 6, is circulated on a traveling rail 242*b* on only the inner circumferential side of the mail sorting line by hanging the transfer basket 230 by one side, a rotational moment F is generated by the conveyor basket 230 itself, and the self weight of mail while using a traveling roller 231*c* provided on a traveling rail 242*b* of the conveyor basket 230 and a guide roller 231*b* provided on the guide rail side as a base point, and excess conveying power is required by traveling resistance due to this rotational moment F. Accordingly, there were problems that upsizing of a driving source is not avoided and errors in transferring the mail from the transfer basket 220 to the conveyor basket 230 can be generated.

The mail sorting line has a horizontal bend and a vertical bend connected by a transfer zone. Further, connecting portions which, connect adjacent conveyor baskets to each other have a rotating shaft, and a rotating shaft of the traveling roller 231*c* and a rotating shaft of the guide roller 231*b* are separately arranged at non-intersection positions respectively, a torsion phenomenon is generated between the traveling roller 231*c* and the guide roller 231*b* in the transfer zone between a horizontal bend and a vertical bend forming a compound curve whose line is not in a plane, but is three-dimensional, and conveying trouble is caused by further traveling resistance due to this torsion phenomenon. Accordingly there was a problem that trouble can occur in a smooth sorting operation of mail M.

SUMMARY OF THE INVENTION

Accordingly, the problem to be solved by the invention, that is the object of the present invention is to solve the problem of the above-described conventional prior art, or to provide a mail sorting and distributing transfer system, which smoothly conveys mail on a mail sorting line in a compound curve whereby the mail can be reliably transferred to a conveyor basket and conveying power savings are developed The invention solves the above-mentioned problems by a mail sorting and distributing transfer system, which receives mail supplied from the mail charging line in a transfer basket hung at an outer circumferential edge of a mail sorting and distributing turn table and transfers the mail to a predetermined conveyor basket, which circulates on a mail sorting line through a transfer port openably provided on the bottom of the transfer basket characterized in that the transfer basket includes an inner circumferential side carriage and an outer circumferential side carriage, which respectively travel on an inner circumferential side rail and an outer circumferential side rail constructed on the mail sorting line while hanging a basket body by both sides in a carried state.

The invention further solves the above-mentioned problems by, in addition to hanging the basket by both sides, contacting the inner circumferential side carriages to each other through a connecting bar having both a traveling roller and a guide roller.

The invention further solves the above-mentioned problems by providing a connecting bar which includes a spherical surface bearing portion, which supports either one of a rotating shaft for the traveling roller and a rotating shaft for the guide roller. The center of the spherical surface bearing portion is arranged to be positioned at the point of intersection of the rotary axes of said rotating shaft for the traveling roller and the rotating shaft for the guide roller.

The term "mail" in the mail sorting and distributing transfer system of the present invention means sheet-shaped mail in which a flat object such as a magazine or the like was sealed in, and the term "mail charging line" means a line including a mail sorting receiver's data reader for conveying mail to a subsequent line for sorting and distributing mail. Further, the term "mail sorting line" means a line for conveying mail in a conveyor basket to a mail recovery box according to required sorting receivers based on sorting receiver's data read by a sorting receiver's data reading mechanism in the mail charging line or the like.

Since the mail sorting and distributing transfer system of the present invention includes peculiar system configurations, the following special effects can be achieved. That is, in the mail sorting and distributing transfer system of the present invention since the conveyor basket includes an inner circumferential side carriage and an outer circumferential side carriage, it can stably, smoothly circulate on an inner circumferential side rail and an outer circumferential side rail constructed on a mail sorting line while hanging the conveyor basket by both sides in a carried state. Further, since the mail sorting and distributing transfer system of the present invention does not receive the influence of a rotational moment generated by a conveyor basket itself and the self weight of the mail, it can reliably transfer the mail from a transfer basket to conveyor basket and effect conveying power savings.

The mail sorting and distributing transfer system of the present invention provides the additional effect that since the inner circumferential side carriages are connected to each other through a connecting bar with a traveling roller and a guide roller being provided, the outer circumferential side carriage is separated from a connecting element for conveyor baskets and absorbs the path difference between the inner circumferential side and outer circumferential side generated during circular traveling to be able to exert a smooth circular operation, and that operations such as a mail sorting operation and a maintenance operation from the outer circumferential side carriage side can be easily attained.

Further, the mail sorting and distributing transfer system of the present invention has the effect that since the connecting bar includes a spherical surface bearing portion, which supports either one of a rotating shaft for the traveling roller and a rotating shaft for the guide roller, and the center of the spherical surface bearing portion is arranged to be positioned at the point of intersection of the rotary axes of the rotating shaft for the traveling roller and the rotating shaft for the guide roller, the traveling roller and guide roller in the conveyor basket smoothly travels even in a transfer zone between a horizontal bend and a vertical bend in the mail sorting line or a compound curve whereby a rapid and accurate mail-sorting operation can be smoothly attained.

According to the mail sorting and distributing transfer system of the present invention, in a mail sorting and distributing transfer system, which receives mail supplied from the mail charging line in a transfer basket hung at an outer circumferential edge of a mail sorting and distributing turn table and transfers the mail to a predetermined conveyor basket, which circulates on a mail sorting line through a transfer port openably provided on the bottom of the transfer basket, the transfer basket includes an inner circumferential side carriage and an outer circumferential side carriage, which respectively travel on an inner circumferential side rail and an outer circumferential side rail mounted on the mail sorting line while hanging a basket body by both sides in a carried state whereby mail can be smoothly conveyed on a mail sorting line through any bend, and conveying power savings are effected.

It is noted that the center of a spherical surface bearing portion of the connecting bar used in the present invention may be arranged to be positioned at the point of intersection of the both axes of a rotating shaft for the traveling roller and a rotating shaft for the guide roller and that the spherical surface bearing portion may support either one of a rotating shaft for the traveling roller and a rotating shaft for the guide roller.

A mail sorting and distributing transfer system, which is one example of the present invention, will be described with reference to drawings below.

DESCRIPTION OF THE PREFERRED EMBODIMENT

Figure 1:
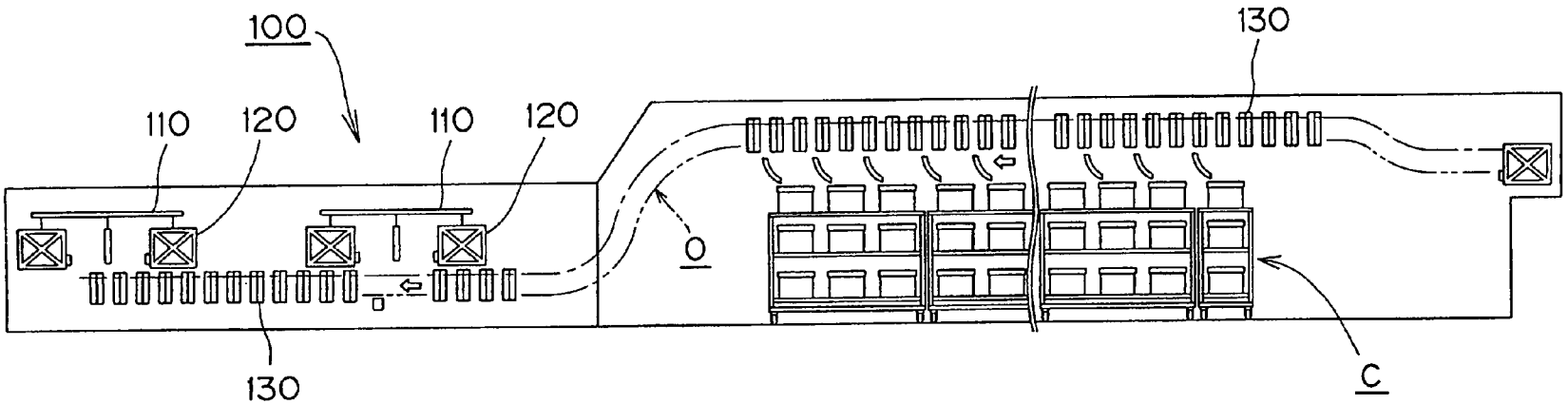
FIG. 1 is a front view showing the embodiment of a mail sorting and distributing transfer system embodying the present invention.
Figure 2:
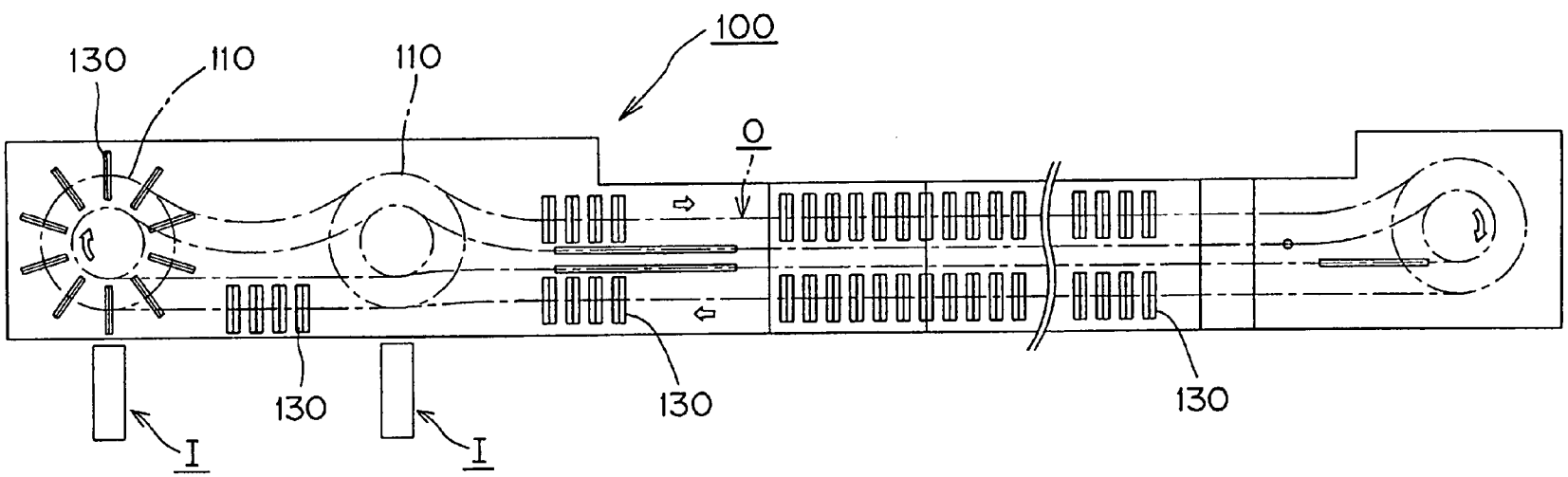
FIG. 2 is a plan view showing an arrangement embodiment of the mail sorting and distributing transfer system illustrated in FIG. 1.

A mail sorting and distributing transfer system 100 embodying the present invention is shown in FIGS. 1 and 2. It receives mail supplied from one of two mail charging lines I (FIG. 2), which includes a mail sorting receiver's data reader and the like, through a transfer basket 120 provided on an outer circumferential edge of a mail sorting and distributing turn table 110. The transfer basket 120 transfers the mail to a conveyor basket 130 on the mail sorting line O.

It is noted that two mail sorting and distributing transfer systems 100 in FIGS. 1 and 2, are provided on a supply side on the mail sorting line O in consideration of the types of mail, efficiency of sorting operation and the like. Further, the reference character C in FIG. 1 denotes mail recovery boxes for sorting and recovering mail from the conveyor basket 130, and the arrow denotes a movement direction of the conveyor basket 130, which is moved just under the transfer basket 120 in synchronization with the transfer basket 120 while circulating on the mail sorting line O.

Figure 3:
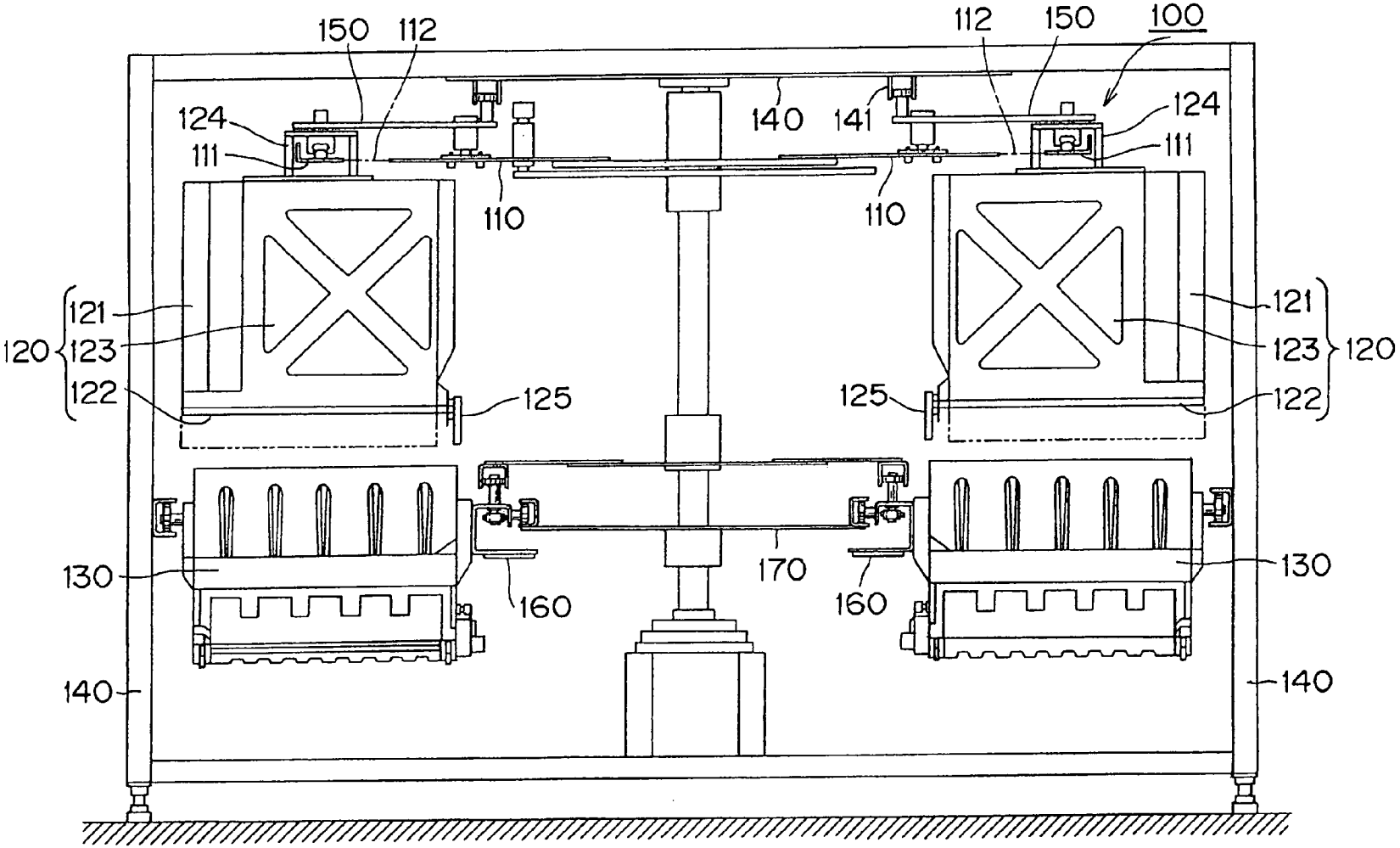
FIG. 3 is a diagrammatic transverse sectional view of the mail sorting and distributing transfer system according to the present invention.

As shown in FIG. 3, the sorting and distributing turn table 110 is journalled on a framework side and connected to a chain wheel 170 for a conveyor basket, which circulates thereunder. Since the transfer basket 120 and the conveyor basket 130 are mechanically synchronized with each other, transferable time in transferring the mail from the transfer baskets 120 to the conveyor baskets 130 can be sufficiently ensured. Further, the sorting and distributing turn table 110 includes arc-shaped guide rails 111, which can slidably guide the transfer baskets 120 and slots 112 for pivotally hanging the transfer baskets 120.

The box-shaped transfer baskets 120 are provided on an outer circumferential edge of the sorting and distributing turn table 110 at regular intervals, and each includes a receipt port 121 for receiving mail supplied through the mail charging line I and a transfer port 122 consisting of an openable bottom lid for transferring the mail to the conveyor basket 130 on the mail sorting line O.

It is noted that the reference numeral 124 in FIG. 3 denotes a mount bracket for mounting a transfer basket body 123 on the sorting and distributing turn table 110 side, and the reference numeral 125 denotes a rocker mechanism, which openably moves the transfer port 122 with an opening/closing mechanism such as a rocker pin, an unrocking lever and the like (not shown).

Further, the framework side fixed frame 140 of the mail sorting and distributing transfer system 100 provides a transfer timing guide 141, which can optionally set transfer start timing for transferring mail from the mail charging line I to the transfer basket 120 and transfer time. By cooperating with a transfer timing lever 150 of the sorting and distributing turn table, which actuates the receipt port 121 of the transfer basket 120 when it is in registry with the mail charging line I during the receipt of mail. At the same time the transfer basket 120 and the conveyor basket 130 are moved in parallel to each other in synchronization with each other during the transfer of the mail.

Figure 4:
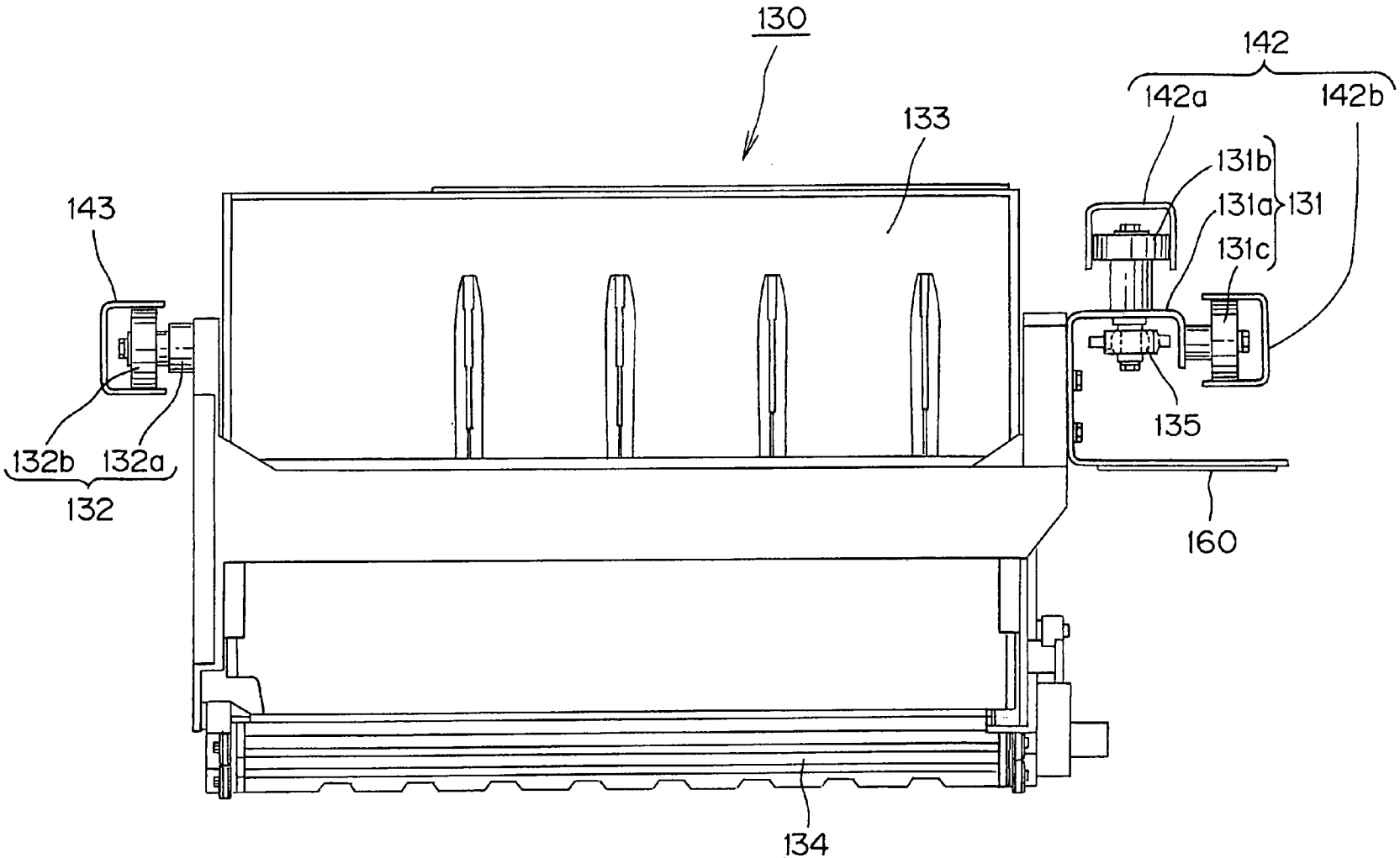
FIG. 4 is an enlarged explanatory view showing a conveying basket in a travel state.

Next, as shown in FIGS. 3 and 4, a conveyor basket 130, which circulates on the mail sorting line O, includes an inner circumferential side carriage 131, which travels on an inner circumferential side rail 142 on the inner circumferential side of the line of baskets 130 and an outer circumferential side carriage 132, which travels on an outer circumferential side rail 143 on the outer circumferential side of the line of baskets. The basket 130 includes a basket body 133, which accommodates and holds mail transferred from the transfer basket 120 until it is sorted. Thus, since this basket body 133 is supported at both sides, it stably moves while it is hung by the inner circumferential side carriage 131 and the outer circumferential side carriage 132 between the rails 142 and 143. The mail sorting and distributing transfer system 100 is not influenced by the conveyor basket 130 itself and the self weight of the mail. The reference numeral 134 in FIG. 4 denotes a discharging bottom plate, which can be opened and closed by an opening/closing rocker mechanism including a rocker pin, and an unlocking lever or the like at a mail receiving station.

Figure 5:
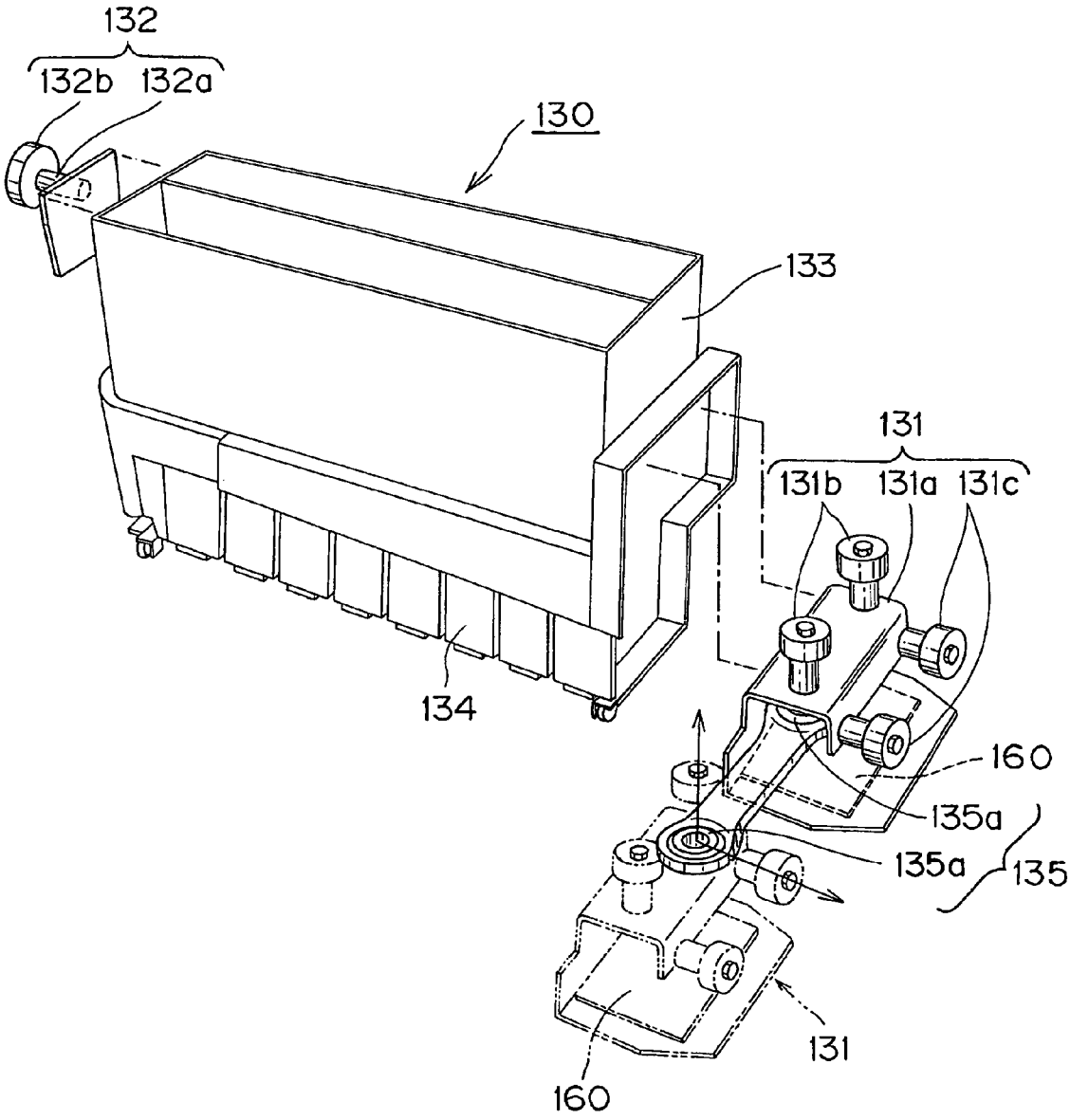
FIG. 5 is an exploded perspective view showing the connection of an inner circumferential side carriage to an adjoining carriage.
Figure 6:
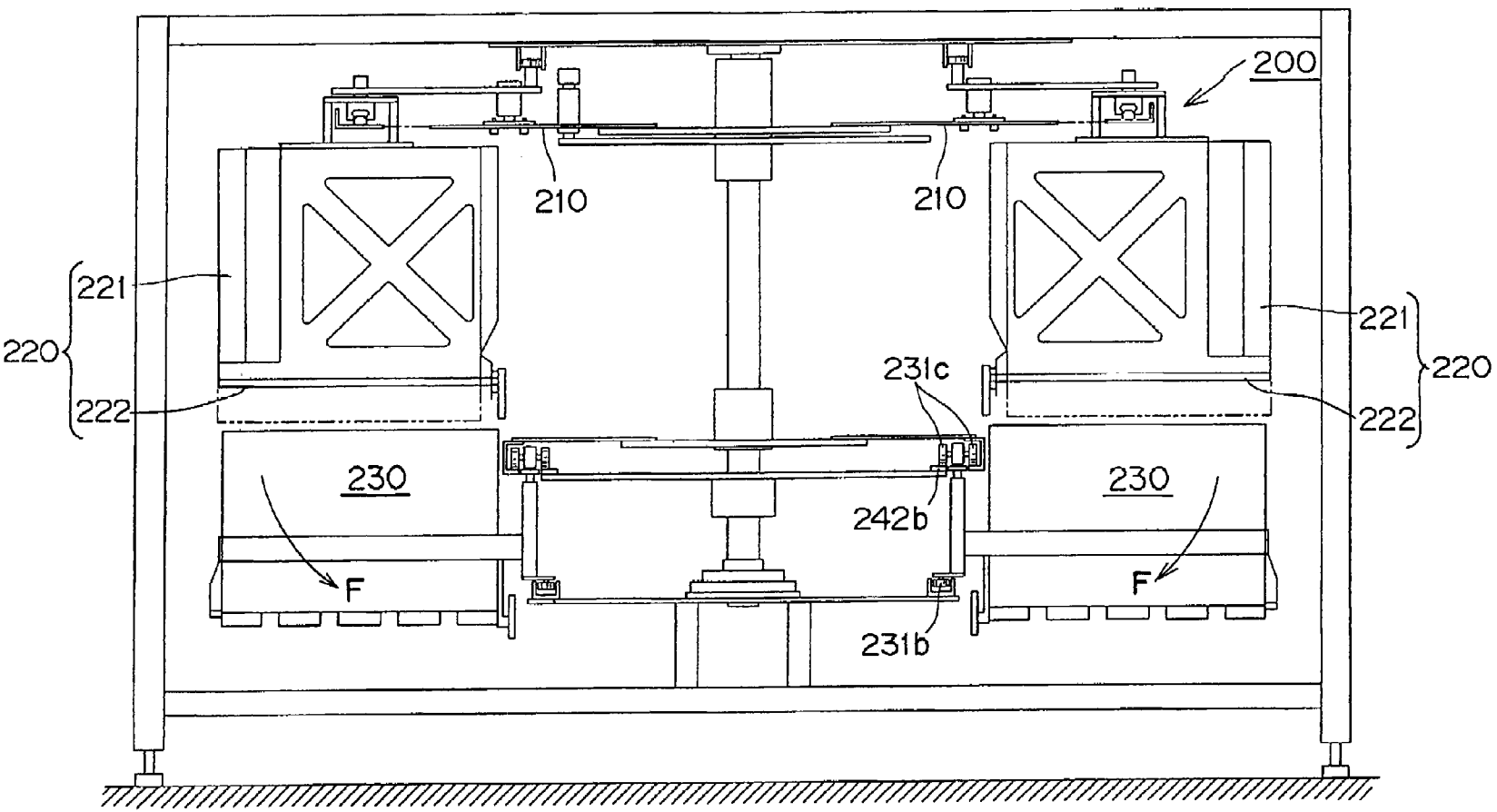
Fig. 6 Related Art
FIG. 6 is a view of an earlier invention of the present inventors.

As shown in FIGS. 4 and 5, the inner circumferential side carriage 131 comprises a carriage body 131*a* mounted on the basket body 133, a pair of front and rear guide rollers 131*b*, 131*b*, which travel on a guide rail 142*a* of the inner circumferential side rail 142 and a pair of front and rear traveling rollers 131*c*, 131*c*, which travel on a guide rail 142*b* of the inner circumferential side rail 142.

On the other hand, the outer circumferential side carriage 132 comprises a carriage body 132*a* mounted on the basket body 133 and one traveling roller 132*b*, which travels on an outer circumferential side rail 143, which functions as a travel rail.

Further, the above-mentioned large number of conveyor baskets 130 are connected to each other through a connecting bar 135, which connects the inner circumferential side carriages 131.

The connecting bar 135 includes a pair of front and rear spherical surface bearing portions 135*a*, 135*a*, which support the rotary shaft of the traveling roller 131*c* of a leading inner circumferential carriage 131 and the rotary shaft of the traveling roller 131*c* of the following inner circumferential side carriage 131.

The center of the spherical surface bearing portion 135*a* is disposed at a point of intersection of the rotary axis of the traveling roller 131*c* and the rotary axis of the guide roller 131*b*, and the traveling roller 131*c* and guide roller 131*b* in the conveyor basket 130 smoothly travels even in a transfer zone between a horizontal bend and a vertical bend forming the mail sorting line O for a compound curve. It is noted that the broken lines shown in FIG. 5 denotes an inner circumferential side carriage 131 to be mounted on the adjoining conveyor basket 130.

The mail sorting and distributing transfer system 100 of the present example is adapted to be driven by a linear motor not shown through a reaction plate 160 provided on the carriage body 131*a* of the inner circumferential side carriage 131 as shown in FIGS. 3 to 5.

In the thus obtained mail sorting and distributing transfer system 100 of the present invention, since the conveyor basket 130 includes an inner circumferential side carriage 131 and an outer circumferential side carriage 132, which respectively travel on an inner circumferential side rail 142 and an outer circumferential side rail 143 of the mail sorting line O while the conveyor basket body is hung by both sides in its carried state, the mail sorting and distributing transfer system 100 does not receive the influence of the rotational moment generated by the transfer basket itself and the self weight of the mail as generated in a mail sorting and distributing transfer system 200, which is a related art of the present invention whereby the conveyor basket 130 can be smoothly conveyed on the mail sorting and distributing line O with a compound curve and conveying power savings can be effected.

Since the inner circumferential side carriages 131 are connected to each other through a connecting bar 135 with the traveling roller 131*c* and the guide roller 131*b* being provided, the outer circumferential side carriage 132 is separated from a connecting element for conveyor basket bodies 133 and absorbs the path difference between the inner circumferential side and outer circumferential side generated during circular traveling to be able to exert a smooth circular operation. Operations such as a mail sorting operation and a maintenance operation from the outer circumferential side carriage 132 side can be easily attained.

Further, since the connecting bar 135 includes a pair of front and rear spherical surface bearing portions 135*a*, 135*a*, which bear a rotating shaft for the traveling roller 131*c* of a leading inner circumferential side carriage 131 and a rotating shaft for the traveling roller 131*c* of the following inner circumferential side carriage 131 and the center of the spherical surface bearing portion is arranged to be positioned at the point of intersection of the rotary axes the rotating shaft for the traveling roller 131*c* and the rotating shaft for the guide roller 131*b*, the traveling roller 131*c* and guide roller 131*c* in the conveyor basket 130 smoothly travels even in a transfer zone between a horizontal bend and a vertical bend forming the mail sorting line O for a compound curve whereby a rapid and accurate mail-sorting operation can be smoothly attained. As the result, the beneficial effects of the present invention are very large.

The invention claimed is:

1. A mail sorting and distributing transfer system comprising a mail sorting line and a plurality of conveyor baskets traveling along said line in which said system receives mail supplied from a mail charging line in a transfer basket hung at an outer circumferential edge of a mail sorting and distributing turn table and transfers the mail to a predetermined conveyor basket, which circulates on a mail sorting line through a transfer port openably provided on the bottom of said transfer basket characterized in that:

the mail sorting line comprises a closed loop having an inner circumferential side rail and an outer circumferential side rail;

said conveyor basket includes an inner circumferential side carriage and an outer circumferential side carriage, which respectively travel on said inner circumferential side rail and said outer circumferential side rail, said basket having a body between said carriages hanging by both sides during travel on said rails, said inner circumferential side carriages being connected to each other through a connecting bar having a traveling roller and a guide roller having intersecting rotary axes, and said connecting bar includes a spherical surface bearing portion, which supports at least one of a rotating shaft for said traveling roller and a rotating shaft for said guide roller, the center of said spherical surface bearing portion being positioned at the point of intersection of said rotary axes of said rotating shaft for the traveling roller and said rotating shaft for the guide roller.

* * * * *